US009416626B2

(12) United States Patent
Xu et al.

(10) Patent No.: US 9,416,626 B2
(45) Date of Patent: Aug. 16, 2016

(54) DOWNHOLE DEBRIS REMOVAL TOOL AND METHODS OF USING SAME

(71) Applicant: Baker Hughes Incorporated, Houston, TX (US)

(72) Inventors: Ying Qing Xu, Tomball, TX (US); Gregory L. Hern, Porter, TX (US); Calvin J. Stowe, II, Bellaire, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 421 days.

(21) Appl. No.: 13/923,430

(22) Filed: Jun. 21, 2013

(65) Prior Publication Data

US 2014/0374111 A1 Dec. 25, 2014

(51) Int. Cl.

| | |
|---|---|
| ***E21B 37/08*** | (2006.01) |
| ***E21B 31/08*** | (2006.01) |
| ***E21B 37/00*** | (2006.01) |
| ***E21B 27/00*** | (2006.01) |

(52) U.S. Cl.
CPC ..... *E21B 37/00* (2013.01); *E21B 27/005* (2013.01)

(58) Field of Classification Search
CPC ..... E21B 37/00; E21B 37/08; E21B 27/005
USPC ..... 166/311, 99
See application file for complete search history.

(56) References Cited

U.S. PATENT DOCUMENTS

| | | | | |
|---|---|---|---|---|
| 2,787,327 A | | 4/1957 | Pearson et al. | |
| 2,819,038 A | * | 1/1958 | Eckel | E21B 4/18 175/100 |
| 2,894,725 A | | 7/1959 | Baker | |
| 3,023,810 A | | 3/1962 | Anderson | |
| 3,102,600 A | * | 9/1963 | Jackson | E21B 21/12 175/215 |
| 3,118,510 A | * | 1/1964 | Woods | E21B 27/00 175/308 |
| 3,198,256 A | * | 8/1965 | Kirby, II | E21B 27/005 166/99 |
| 3,332,497 A | | 7/1967 | Page, Jr. | |
| 3,360,048 A | | 12/1967 | Watkins | |

(Continued)

FOREIGN PATENT DOCUMENTS

| | | |
|---|---|---|
| CN | 2883658 Y | 3/2007 |
| GB | 2348226 A | 9/2000 |

(Continued)

OTHER PUBLICATIONS

Don M. Hannegan, et al., Technologies Manage Well Pressures, The American Oil & Gas Reporter, Sep. 2001, pp. 87-93, National Publishers Group Inc., U.S.A.

(Continued)

*Primary Examiner* — Michael Wills, III
(74) *Attorney, Agent, or Firm* — Steve Rosenblatt

(57) ABSTRACT

A downhole tool for removing debris from a wellbore comprises a mandrel and a shroud disposed around a portion of the mandrel. The mandrel includes at least one mandrel port in fluid communication with a mandrel bore. The shroud includes a cavity and a shroud port. Debris laden fluid is pulled into the shroud cavity by flowing fluid through the mandrel bore, out the mandrel port, into the shroud cavity, and through the shroud port. The debris-laden fluid is pulled into the shroud cavity due to a pressure differential created by the flow of the fluid through the mandrel port and out of the shroud port. As the debris laden fluid flows into the shroud cavity, the debris is captured within the tool.

21 Claims, 7 Drawing Sheets

(56) References Cited

U.S. PATENT DOCUMENTS

| | | | | |
|---|---|---|---|---|
| 3,500,933 | A | 3/1970 | Burba, Jr. et al. | |
| 3,814,180 | A * | 6/1974 | Oliver | E21B 21/103 166/99 |
| 4,059,155 | A | 11/1977 | Greer | |
| 4,111,262 | A | 9/1978 | Duncan | |
| 4,217,966 | A | 8/1980 | Garrett | |
| 4,276,931 | A | 7/1981 | Murray | |
| 4,335,788 | A | 6/1982 | Murphey et al. | |
| 4,390,064 | A | 6/1983 | Enen, Jr. et al. | |
| 4,515,212 | A | 5/1985 | Krugh | |
| 4,588,243 | A | 5/1986 | Ramsey et al. | |
| 4,828,026 | A | 5/1989 | Nelson | |
| 4,857,175 | A | 8/1989 | Spinnler | |
| 4,880,059 | A | 11/1989 | Brandell et al. | |
| 5,228,518 | A | 7/1993 | Wilson et al. | |
| 5,425,424 | A | 6/1995 | Reinhardt et al. | |
| 5,524,709 | A | 6/1996 | Withers | |
| 5,533,373 | A | 7/1996 | Plester | |
| 6,112,812 | A | 9/2000 | Carter | |
| 6,179,057 | B1 | 1/2001 | Fontana et al. | |
| 6,202,752 | B1 | 3/2001 | Kuck et al. | |
| 6,276,452 | B1 | 8/2001 | Davis et al. | |
| 6,341,653 | B1 | 1/2002 | Firmaniuk et al. | |
| 6,352,129 | B1 | 3/2002 | Best | |
| 6,361,272 | B1 | 3/2002 | Bassett | |
| 6,397,959 | B1 | 6/2002 | Villarreal | |
| 6,427,776 | B1 | 8/2002 | Hoffman et al. | |
| 6,446,737 | B1 | 9/2002 | Fontana et al. | |
| 6,543,538 | B2 | 4/2003 | Tolman et al. | |
| 6,568,475 | B1 | 5/2003 | Grubb et al. | |
| 6,607,031 | B2 | 8/2003 | Lynde et al. | |
| 6,655,459 | B2 | 12/2003 | Mackay | |
| 6,719,071 | B1 | 4/2004 | Moyes | |
| 6,755,256 | B2 | 6/2004 | Murley et al. | |
| 6,951,251 | B2 | 10/2005 | Penisson | |
| 7,069,992 | B2 | 7/2006 | Lewis et al. | |
| 7,096,975 | B2 | 8/2006 | Aronstam et al. | |
| 7,114,581 | B2 | 10/2006 | Aronstam et al. | |
| 7,174,975 | B2 | 2/2007 | Krueger et al. | |
| 7,188,675 | B2 * | 3/2007 | Reynolds | E21B 27/005 166/311 |
| 7,267,172 | B2 | 9/2007 | Hofman | |
| 7,472,745 | B2 * | 1/2009 | Lynde | E21B 27/005 166/165 |
| 7,478,687 | B2 | 1/2009 | Lynde et al. | |
| 7,497,260 | B2 | 3/2009 | Telfer | |
| 7,513,303 | B2 | 4/2009 | Hern | |
| 7,610,957 | B2 | 11/2009 | Davis et al. | |
| 7,721,822 | B2 | 5/2010 | Krueger et al. | |
| 7,753,113 | B1 | 7/2010 | Penisson | |
| 7,806,203 | B2 | 10/2010 | Krueger et al. | |
| 7,861,772 | B2 | 1/2011 | Blair | |
| 7,987,901 | B2 | 8/2011 | Krueger et al. | |
| 8,011,450 | B2 | 9/2011 | Krueger et al. | |
| 8,109,331 | B2 * | 2/2012 | Lynde | E21B 37/00 166/105.3 |
| 8,973,662 | B2 * | 3/2015 | Xu | E21B 27/00 166/105.1 |
| 2001/0050185 | A1 | 12/2001 | Calder et al. | |
| 2003/0098181 | A1 | 5/2003 | Aronstam et al. | |
| 2004/0251033 | A1 | 12/2004 | Cameron et al. | |
| 2005/0061508 | A1 | 3/2005 | Surjaatmadja | |
| 2010/0243258 | A1 | 9/2010 | Fishbeck et al. | |
| 2011/0024119 | A1 | 2/2011 | Wolf et al. | |
| 2011/0203848 | A1 | 8/2011 | Krueger et al. | |
| 2012/0160503 | A1 | 6/2012 | Davis | |
| 2013/0168091 | A1 | 7/2013 | Xu et al. | |
| 2013/0341027 | A1 * | 12/2013 | Xu | E21B 27/005 166/301 |

FOREIGN PATENT DOCUMENTS

| | | |
|---|---|---|
| WO | WO 99/22112 | 5/1999 |
| WO | WO 00/04269 | 1/2000 |
| WO | WO 00/08295 | 2/2000 |
| WO | WO 03/006778 A1 | 1/2003 |
| WO | WO 03/025336 A1 | 3/2003 |

OTHER PUBLICATIONS

Anthony Hill and William Furlow, New Tool Addresses ECD Problem, Offshore, Jun. 2002, pp. 88-89, U.S.A., retrieved May 14, 2012, from http://www.pennenergy.com/index/petroleum/display/149477/articles/offshore/volume-62/issue-6/departments/drilling-production/new-tool-addresses-ecd-problem.html, pp. 1-3.

P.A. Bern, et al., A New Downhole Tool for ECD Reduction, Feb. 19, 2003, pp. 1-4, SPE/IADC 79821, Society of Petroleum Engineers Inc., U.S.A.

Sven Kruger, TurboLift Advanced ECD Control, Apr. 2005, pp. 1-13, Baker Hughes Incorporated/INTEQ, U.S.A.

* cited by examiner

DOWNHOLE DEBRIS REMOVAL TOOL AND METHODS OF USING SAME

BACKGROUND

1. Field of Invention

The invention is directed to a downhole clean-up tool or junk basket for use in oil and gas wells, and in particular, to a downhole clean-up tool that is capable of creating a pressure differential to transport debris from within the wellbore annulus into the tool where it can be collected by the tool.

2. Description of Art

Downhole tools for clean-up of debris in a wellbore are generally known and are referred to as "junk baskets." In general, the junk baskets have a screen or other structure that catches debris as debris-laden fluid flows through the screen of the tool. Generally, this occurs because at a point in the flow path, the speed of the fluid carrying the debris decreases such that the junk or debris falls out of the flow path and into a basket or screen.

SUMMARY OF INVENTION

Broadly, downhole tools for clean-up of debris within a well comprise a shroud having a cavity disposed around the outer wall surface of a mandrel. A fluid pumped downward through the tool travels through the bore of the mandrel, out of one or more mandrel ports, and into the cavity of the shroud. The fluid exiting each of the mandrel ports flows through one or more shroud ports disposed in the shroud. In flowing fluid out of the one or more mandrel ports, a low pressure zone is created at the upper end of the shroud causing wellbore fluid to flow from the wellbore annulus into the cavity. In certain specific embodiments, the debris carried in the wellbore fluid is trapped by a screen disposed in the cavity so that the debris is captured within the cavity. In other different specific embodiments, the debris is captured by flowing the wellbore fluid around at least one baffle disposed within the cavity that causes the debris to fall out of the flow path and, therefore, remain in the cavity. In yet other different embodiments, the wellbore fluid flows through two additional shrouds nested around the shroud in alternating orientations and through a plurality of apertures disposed at the upper end of the shroud so that the debris is captured in one of these two additional shrouds.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
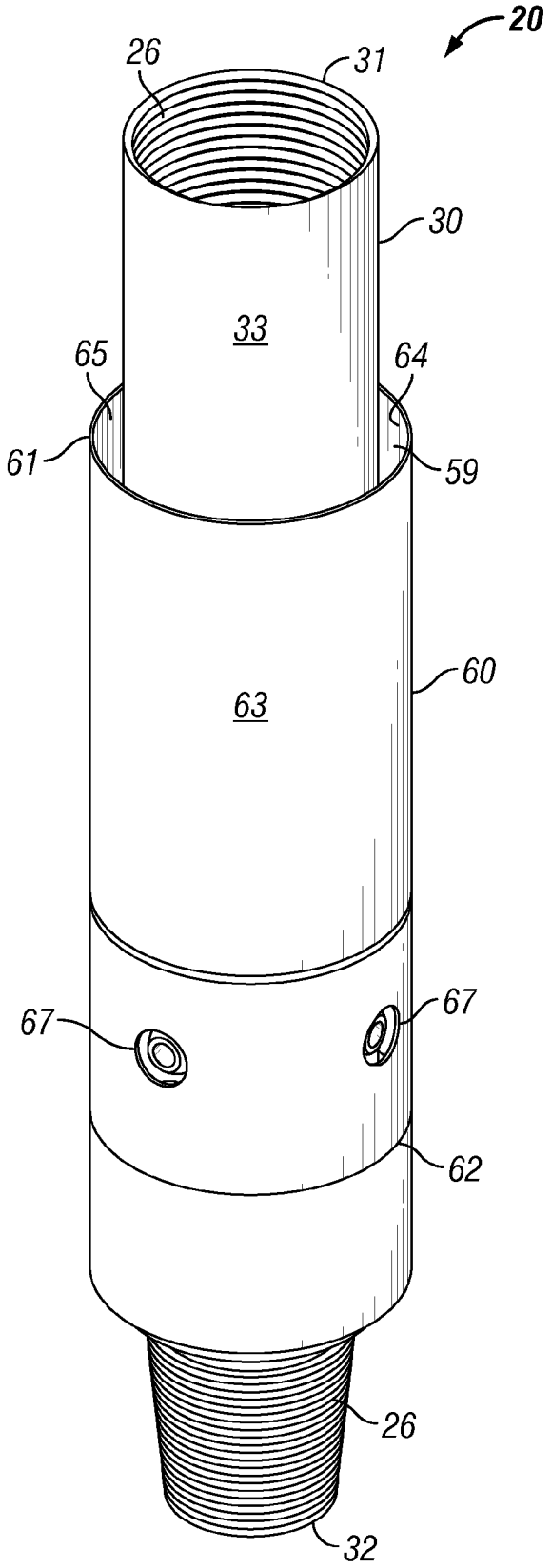
FIG. 1 is a perspective view of a specific embodiment of a downhole tool disclosed herein.
Figure 2:
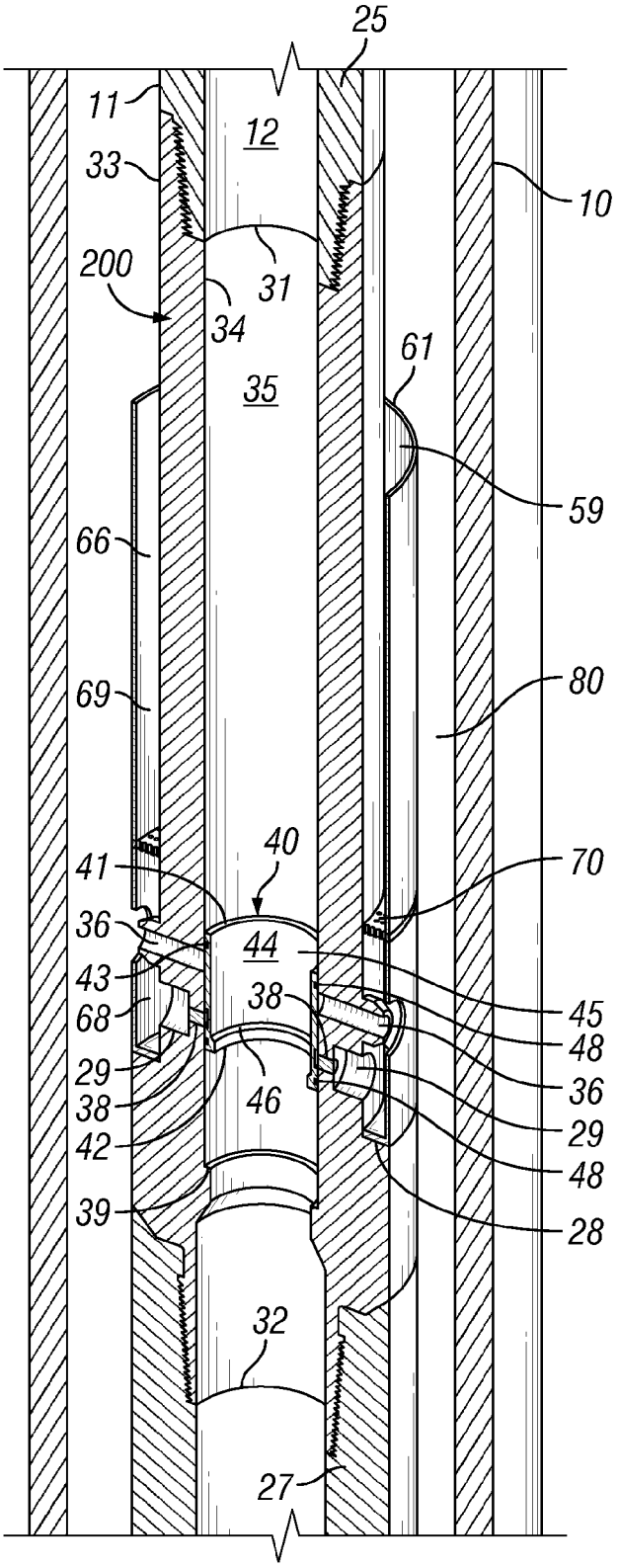
FIG. 2 is a partial cross-sectional view and partial perspective view of the downhole tool shown in FIG. 1 showing the downhole tool disposed in a wellbore in an initial or run-in position.
Figure 3:
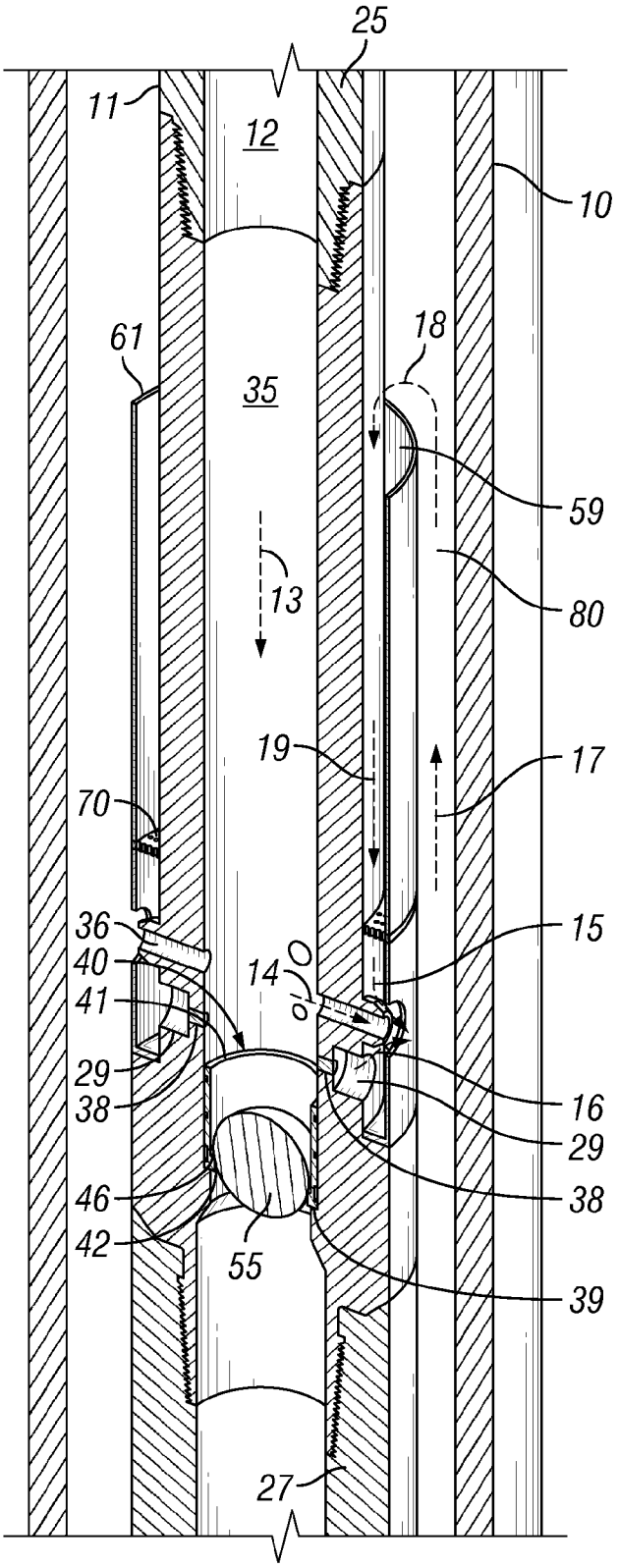
FIG. 3 is a partial cross-sectional view and partial perspective view of the downhole tool shown in FIG. 1 showing the downhole tool disposed in the wellbore in an actuated or operational position.

Referring now to FIGS. 1-3, in one particular embodiment, downhole tool 20 is disposed in wellbore 10 on work or tool string 11 having tool string bore 12 (FIGS. 2-3). Wellbore 10 can be an open-hole well or a cased well.

In the embodiment of FIGS. 1-3, downhole tool 20 comprises mandrel 30 having upper end 31, lower end 32, outer wall surface 33, and inner wall surface 34 defining mandrel bore 35. Threads 26 are disposed at upper and lower ends 31, 32 for connecting downhole tool 20 within tool string 11 such as one having tool string components 25, 27 (FIGS. 2-3). Disposed through outer wall surface 33 and inner wall surface 34 in fluid communication with mandrel bore 35 are mandrel ports 36. Although multiple mandrel ports 36 are shown, it is to be understood that certain embodiments include only one mandrel port 36.

Mandrel ports 36 can include a shape or insertable device such that fluid is accelerated as it flows from mandrel bore 35 through mandrel ports 36. In one particular embodiment, each of mandrel ports 36 comprises a shape to form a nozzle. Alternatively, mandrel ports 36 can include a removable nozzle device (not shown).

As illustrated in FIGS. 1-3, each of mandrel ports 36 is disposed perpendicularly relative to mandrel bore 35. It is to be understood, however, that one or more of mandrel port(s) 36 are not required to be oriented in this manner. Instead, one or more of mandrel port(s) 36 can be disposed at an angle other than perpendicular relative to mandrel bore 35. For example, one or more mandrel port(s) 36 can be orientated in a downward or upward angle relative to mandrel bore 35.

Disposed around a portion of outer wall surface 33 of mandrel 30 is basket or shroud 60. Shroud 60 includes upper end 61, lower end 62, outer wall surface 63, and inner wall surface 64 defining bore 65. Lower end 62 is closed through its connection to outer wall surface 33 of mandrel 30 such as by connecting lower end 62 to shoulder 28 disposed on outer wall surface 33 of mandrel 33. Upper end 61 includes opening 59 as it is not connected to outer wall surface 33 of mandrel 30. As a result, cavity 66 is defined by outer wall surface 33, inner wall surface 64, and lower end 62.

Disposed around the circumference of shroud 60 is one or more fluid flow ports 67 also known as shroud ports. Each fluid flow port 67 is in fluid communication with outer wall surface 63 and inner wall surface 64 and, thus, cavity 66. Although two fluid flow ports 67 are shown in FIGS. 1 and 2, it is to be understood that as few as one fluid flow port 67 may be included in shroud 60, or more than two fluid flow ports 67 may be included in shroud 60.

As illustrated in FIGS. 1-3, fluid flow ports 67 are disposed perpendicularly relative to cavity 66. It is to be understood, however, that one or more of fluid flow ports 67 are not required to be oriented in this manner. Instead, one or more of fluid flow ports 67 can be disposed at an angle other than perpendicular relative to cavity 66. For example, one or more of fluid flow ports 67 may be angled upwardly or downwardly relative to cavity 66.

In addition, as shown in the embodiment of FIGS. 1-3, each fluid flow port 67 is in alignment with a respective mandrel port 36. It is to be understood, however, that each fluid flow port 67 is not required to be in alignment with a respective mandrel port 36. Instead, one or more or all of the fluid flow ports 67 can be out of alignment with the mandrel ports 36.

As best shown in FIGS. 2 and 3, screen member 70 is disposed within cavity 66 thereby dividing cavity 66 into lower cavity 68 and upper cavity 69. Screen member 70 includes one or more apertures for permitting fluid and debris having a size smaller than the one or more apertures to flow there-through. As shown in FIGS. 2-3, screen member 70 is connected to outer wall surface 33 of mandrel 30 and inner wall surface 64 of shroud 60. In addition, screen member 70 is disposed perpendicularly relative to both outer wall surface 33 of mandrel 30 and inner wall surface 64 of shroud 60. It is to be understood, however, that screen member 70 is not required to be disposed perpendicularly relative to both outer wall surface 33 of mandrel 30 and inner wall surface 64 of shroud 60, but instead can be disposed at another angle relative to one or both of outer wall surface 33 of mandrel 30 and inner wall surface 64 of shroud 60. In addition, screen member 70 can have any shape desired or necessary to filter debris from fluid flowing through screen member 70. For example, screen member 70 can be a three-dimensional filter or a relatively flat filter.

As also shown in FIGS. 2-3, screen member 70 is disposed above mandrel ports 36 and fluid flow ports 67.

Operatively associated with mandrel port(s) 36 is a valve member that selectively opens mandrel port(s) 36. As shown in FIGS. 2-3, the valve member comprises sleeve 40 having upper end 41, lower end 42, outer wall surface 43, and inner wall surface 44 defining bore 45. Disposed toward lower end 42 along inner wall surface 44 is seat 46. Outer wall surface 43 is in sliding engagement with inner wall surface 34 of mandrel 30. One or more seal members 48 are disposed around the circumference of outer wall surface 43 of sleeve 40 to isolate mandrel port(s) 36 until actuated. Shear screw 38 or other retaining member holds sleeve 40 in the initial or run-in position (FIG. 2) until actuation of sleeve 40. In the embodiment of FIGS. 1-3, outer wall surface 33 of mandrel 30 includes cavities 29 which facilitate insertion of shear screws 38.

Actuation of sleeve 40 can be accomplished by landing a plug member such as ball 55 on seat 46 and increasing fluid pressure above ball 55. Upon reaching a certain pressure above ball 55, the increased pressure forces ball 55 into seat 46 which, in turn, causes sleeve 40 to slide downward along inner wall surface 34 of mandrel 30. Sleeve 40 continues its downward movement until lower end 42 of sleeve 40 engages shoulder 39 disposed on inner wall surface 34 of mandrel 30. Thus, sleeve 40 has an initial or run-in position (FIG. 2) in which mandrel each of ports 36 are closed or blocked off to fluid flow, and a fully actuated position (FIG. 3) in which each of mandrel port(s) 36 is opened to fluid flow. However, it is to be understood that sleeve can have other actuated positions (not shown) in which less than all of mandrel ports 36 are opened. In the preferred embodiment, sleeve 40 is disposed in its fully actuated position having all mandrel ports 36 opened to fluid flow.

In operation, downhole tool 20 is placed in tool string 11 and lowered to the desired location within wellbore 10 (FIGS. 2-3). Upon reaching the desired location, plug member such as ball 55 is transported down bore 12 of tool string 11 and into mandrel bore 35 until it lands on seat 46 of sleeve 40. Upon landing on seat 46, fluid flow through seat 46 is blocked. Thus, additional fluid flow in the direction of arrow 13 (FIG. 3) down bore 12 of tool string 11 and into mandrel bore 35 causes an increase in pressure above ball 55. Upon reaching a certain pressure, sleeve 40 is forced downward within mandrel bore 35 from its initial or run-in position (FIG. 2) to its fully actuated position (FIG. 3) such that all of mandrel ports 36 are no longer blocked to fluid flow. Although FIG. 3 shows sleeve landed on shoulder 39, it is to be understood that sleeve 40 is not required to be landed on shoulder 39 before reaching either the fully actuated position (FIG. 3) at which all of mandrel ports 36 are opened, or any other actuated position of sleeve 40, i.e., any position at which not all of mandrel ports 36 are opened.

Upon mandrel ports 36 being opened, the fluid being pumped downward through mandrel bore 35 (referred to as "incoming fluid") is directed through mandrel ports 36 in the direction of arrow 14 (FIG. 3). As a result, the velocity of the incoming fluid is increased as it exits mandrel ports 36. The now accelerated incoming fluid flowing out of mandrel ports 36 flows out of fluid flow ports 67 of shroud 60 and into wellbore 10. In addition, fluid flowing from above and below mandrel ports 36 (arrows 15, 16 respectively) flows through fluid flow ports 67 of shroud 60.

Upon exiting fluid flow ports 67, the incoming fluid mixes with wellbore fluid contained within annulus 80 of wellbore 10. The wellbore fluid includes one or more pieces of debris. The mixture of the incoming fluid exiting fluid flow ports 67 and the wellbore fluid is referred to herein as the "combination fluid." The combination fluid is carried upward within wellbore 10 in the direction of arrow 17. As a result, debris that is desired to be captured by tool 20 is carried upward. Upon reaching upper end 61 of shroud 60, the pressure differential across screen member 70 created by the accelerated flow of incoming fluid exiting mandrel ports 36 causes the combination fluid to be drawn into cavity 66 and, thus, toward screen member 70 as indicated by arrow 18 (FIG. 3). The combination fluid continues to be pulled downward (arrow 19) and ultimately through screen member 70 (FIG. 3). In so doing, debris within the combination fluid is prevented from flowing through screen member 70 and is captured within upper cavity 69. The portion of combination fluid that can pass through screen member 70 (arrow 15) mixes with the incoming fluid flowing out of mandrel ports 36 from mandrel bore 35 and is carried through fluid flow ports 67 into annulus 80 of wellbore 10.

It is to be understood that even though some of the combination fluid mixes with the incoming fluid after the combination fluid passes through screen member 70, and some of this combination fluid may still contain small debris within it, for simplicity, the resulting mixture of the fluid that has passed through screen member 70 and fluid that is flowing from mandrel bore 35 through mandrel ports 36 continues to be referred to herein as the "incoming fluid." Thus, the term "incoming fluid" means any fluid flowing out of fluid flow ports 67 and "combination fluid" means the mixture of the fluid that has exited fluid flow ports 67 and combined with the wellbore fluid in annulus 80 that is available to be pulled into cavity 66 through opening 59 when the incoming fluid exits mandrel ports 36.

Circulation of the combination fluid upward can be facilitated by placing tool 20 above a restriction or blockage within wellbore 10. For example, tool 20 can be placed near a bridge plug, packer, or other isolation device. Alternatively, tool 20 can be placed toward the bottom of wellbore 10.

Downhole tool 20 can remain within wellbore 10 until upper cavity 68 is filled with debris or until all debris within wellbore 10 is captured within upper cavity 68. Thereafter, downhole tool 20 is removed from wellbore 10 and, in so doing, the debris captured within upper cavity 68 is also removed.

Figure 4:
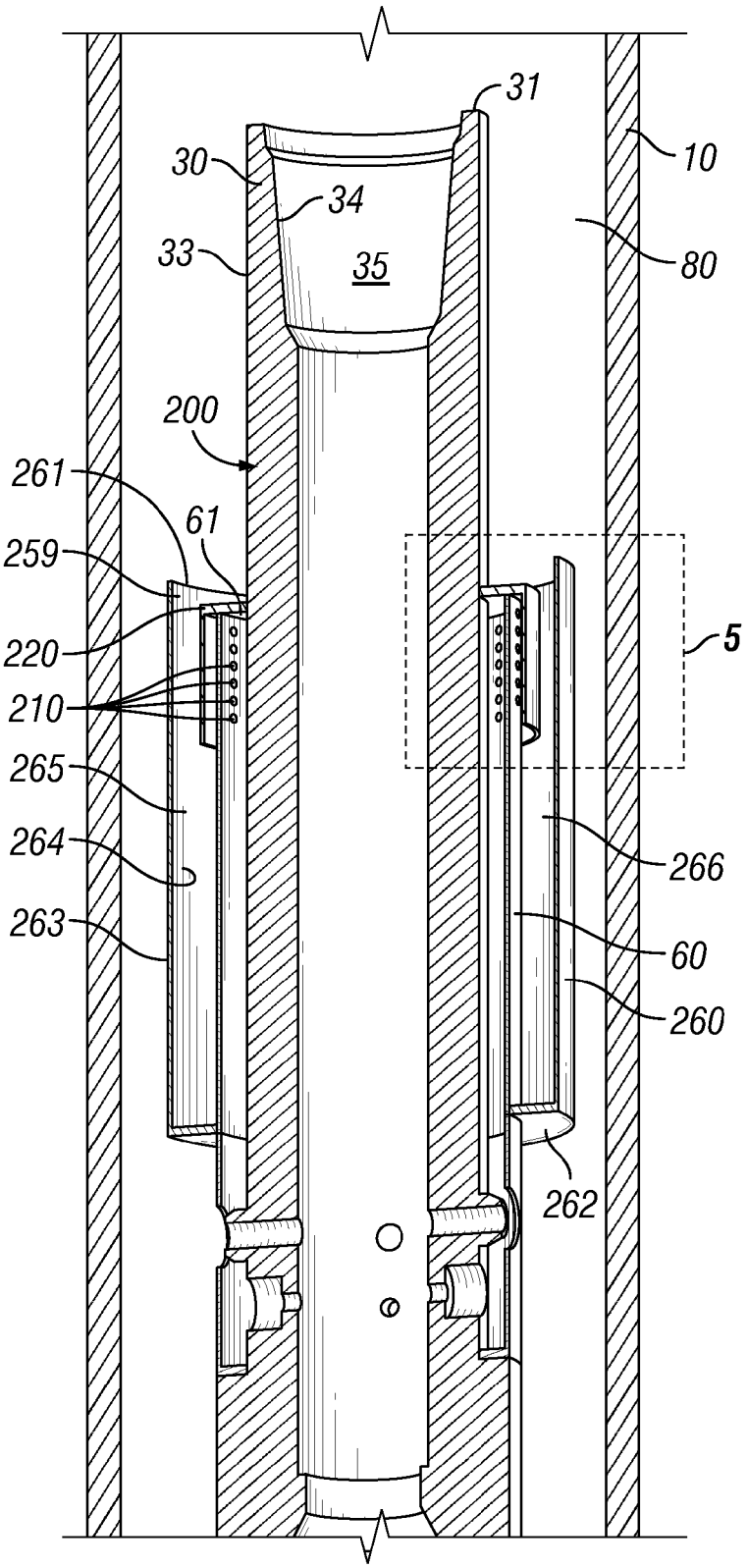
FIG. 4 is a partial cross-sectional view and partial perspective view of another specific embodiment of a downhole tool disclosed herein.
Figure 5:
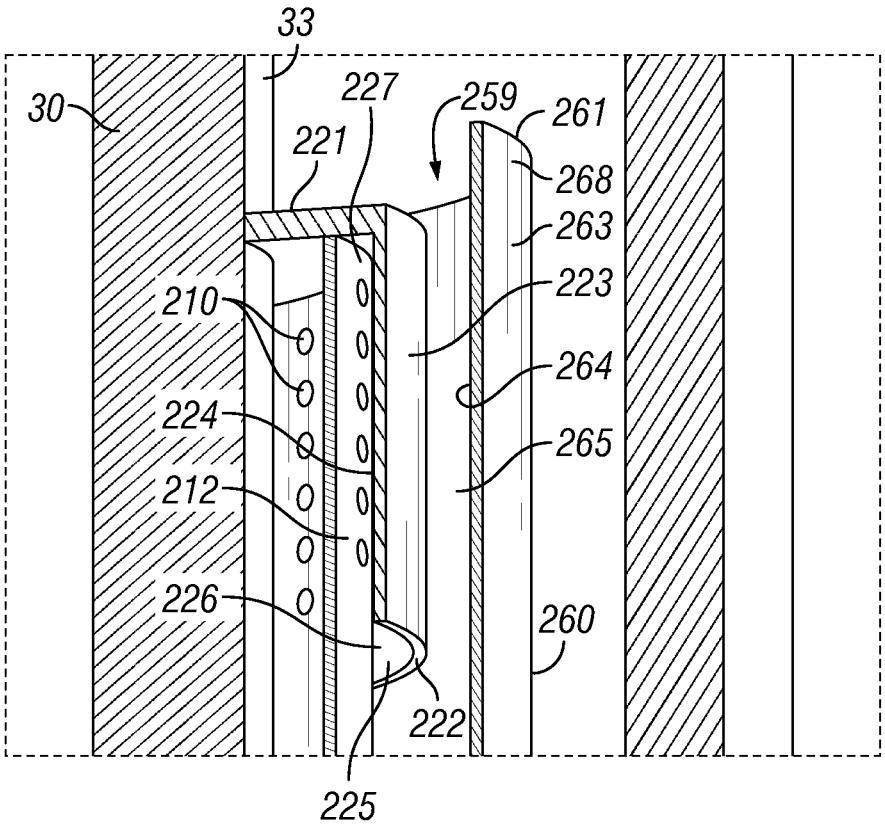
FIG. 5 is a partial cross-sectional view and partial perspective view of the downhole tool shown in FIG. 4 taken along the line 5-5.

Referring now to FIGS. 4-5, in another specific embodiment, downhole tool 200 comprises many of the same components and structures described above with respect to the embodiments of FIGS. 1-3 and, therefore, use like reference numerals in this embodiment. The main differences between the embodiments of FIGS. 1-3 and the embodiments of FIGS. 4-5 is the addition of one or more ingress apertures 210 disposed toward upper end 61 of shroud 60 and the inclusion of cap 220 and outer shroud 260.

Cap 220 closes opening 59 at upper end 61 of shroud 60. In the specific embodiment of FIGS. 4-5, cap 220 comprises a shroud having upper end 221, lower end 222, outer wall surface 223, and inner wall surface 224 defining bore 225. Upper end 221 is closed through its connection to outer wall surface 33 of mandrel 30 such as through welding, threads and the like. Lower end 222 includes opening 226 as it is not connected to outer wall surface 33 of mandrel 30 or to any other structure. As a result, cavity 227 is defined by upper end 221, inner wall surface 224, and outer wall surface 33 of mandrel 30.

As upper end 61 of shroud 60 is closed off by cap 220, upper portion 212 of shroud 60 is disposed within cavity 227 such that at least one of apertures 210 is disposed within cavity 227.

In an alternative embodiment (not shown), cap 220 is not a shroud, but instead simply closes opening 59. In this embodiment, one or more apertures such as apertures 210 are disposed through the walls of shroud 60 and, in certain embodiments, along the entire outer and inner wall surfaces 63, 64 of shroud 60.

Outer shroud 260 is disposed around a portion of outer wall surface 63 of shroud 60 and at least a portion of outer wall surface 223 of cap 220.

Outer shroud 260 includes upper end 261, lower end 262, outer wall surface 263, and inner wall surface 264 defining bore 265. Lower end 262 is closed through its connection to outer wall surface 63 of shroud 60 above fluid flow port(s) 67 such through welding, threads and the like. Upper end 261 includes opening 259 as it is not connected to outer wall surface 63 of shroud 60, or any other surface. As a result, cavity 266 is defined by inner wall surface 264, outer wall surface 63 of shroud 60, and lower end 262.

In the embodiments in which cap 220 is a shroud (FIGS. 4-5), cap 220 is referred to as a "middle shroud" and shroud 60 is referred to as an "inner shroud." As illustrated in FIGS. 4-5, inner and outer wall surfaces 223, 224 of cap 220 are disposed within cavity 266. Similarly, upper portion 212 of shroud 60 is disposed within cavity 227 of cap 220. In addition, an upper portion 268 of outer shroud 260 extends above cap 220 and, thus, upper end 61 of shroud 60.

In operation, the embodiments of FIGS. 4-5 function in a similar manner as described above with respect to the embodiments of FIGS. 1-3. Instead of the combination fluid entering opening 59 of upper end 61 of shroud 60 as in the embodiments of FIGS. 1-3, in the embodiments of FIGS. 4-5, the combination fluid flows through opening 259 into cavity 266 of outer shroud 260. The combination fluid then flows into cavity 227 of cap 220 and through aperture(s) 210 disposed through inner and outer wall surfaces 63, 64 of shroud 60. In so doing, debris within the combination fluid is collected in cavity 266 of outer shroud 260. It is to be understood, however, that some debris could travel through aperture(s) 210 and into cavity 66 of shroud 60 where it could be trapped within cavity 66 by a screen member (not shown), or it may pass through the screen member and flow out of fluid flow port(s) 67. In an alternative embodiment, a screen member, such screen member 70, is not included. Instead, any filter or screening of the fluid is performed only by apertures 210.

In an alternative embodiment of FIGS. 4-5 (not shown), cap 220 is a shroud as shown in FIGS. 4-5, but apertures 210 are absent and cap 220 does not close off opening 59. In other words, cap 220 is disposed above shroud 60 such that upper end 221 of cap 220 does not touch upper end 61 of shroud 60. Thus, a circuitous flow path is created in which fluid enters cavity 226, flows upward through cavity 227, through opening 59, and into cavity 66. In so doing, debris falls out of the fluid flowing into cavity 266, through cavity 227, through opening at upper end 61 of shroud 60, and into cavity 66.

Figure 6:
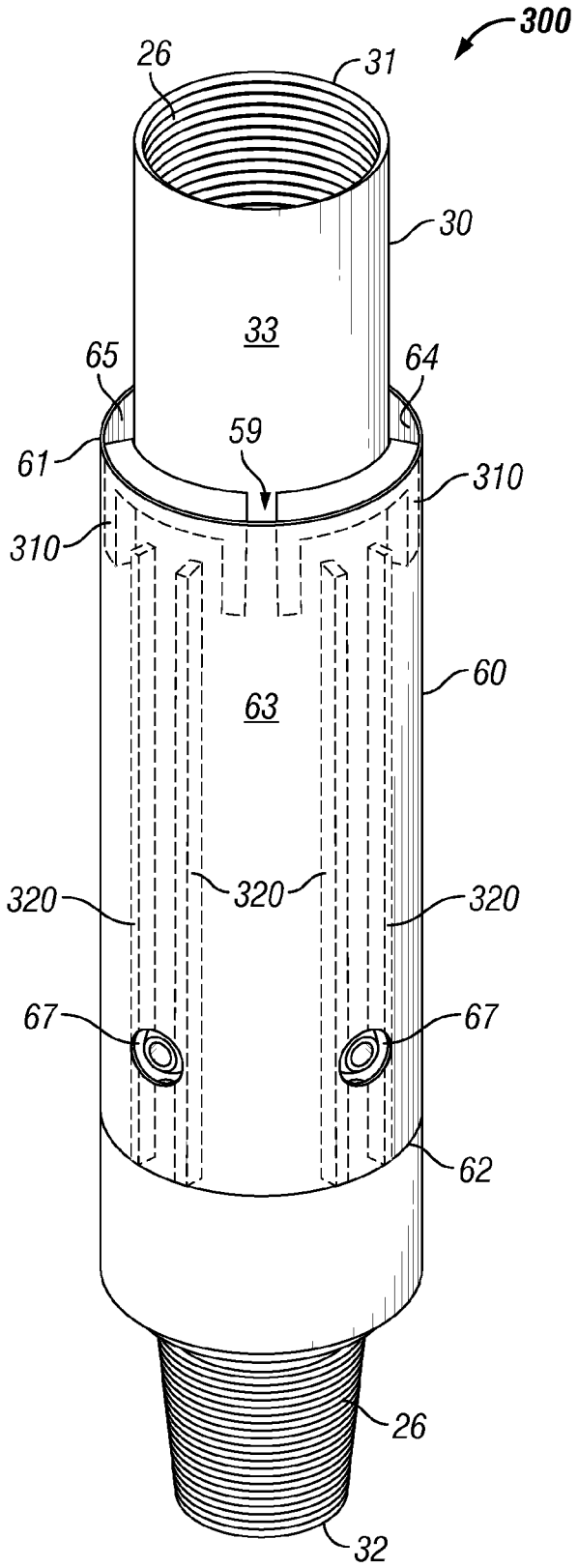
FIG. 6 is a perspective view of an additional specific embodiment of a downhole tool disclosed herein.
Figure 7:
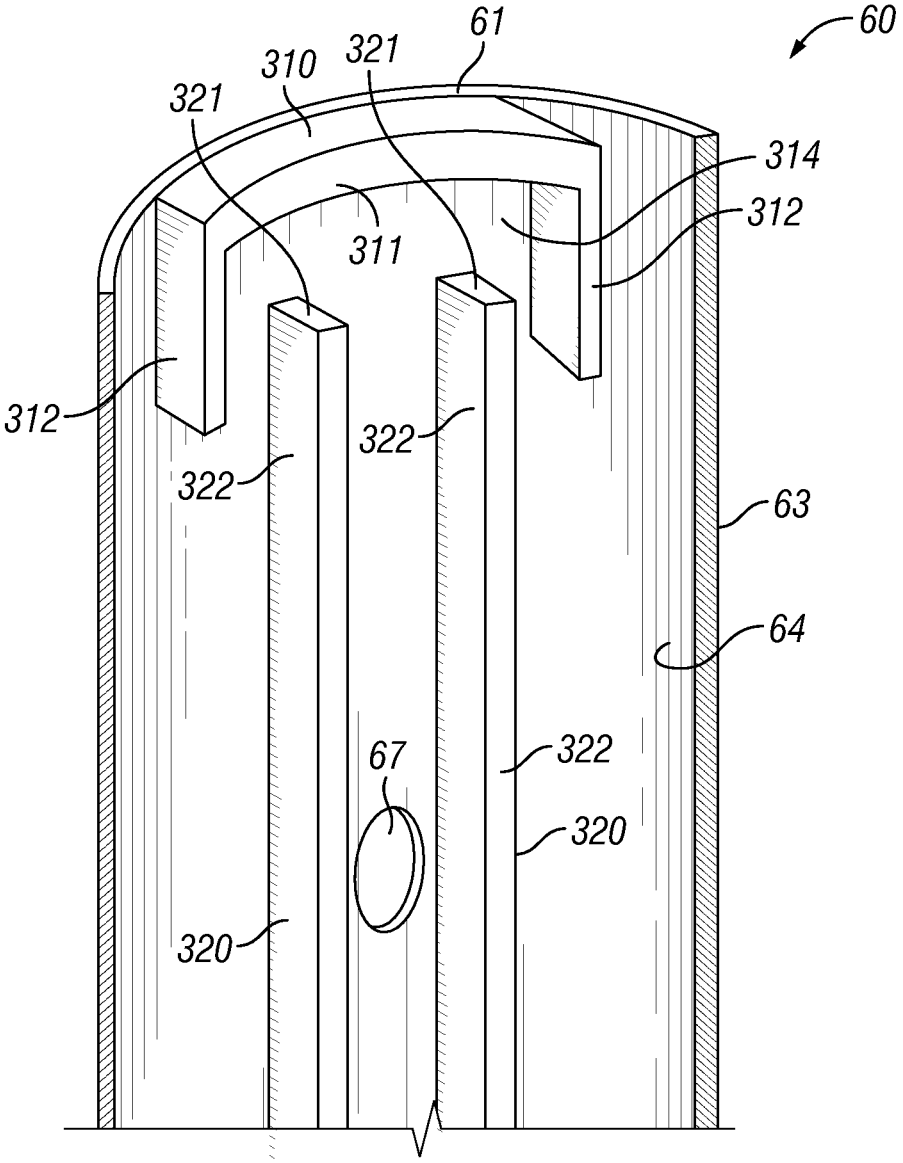
FIG. 7 is a partial cross-sectional view and partial perspective view of the shroud of the downhole tool shown in FIG. 6.

Referring now to FIGS. 6-7, in another specific embodiment, downhole tool 300 comprises many of the same components and structures described above with respect to the embodiments of FIGS. 1-3 and, therefore, use like reference numerals in this embodiment. The main difference between the embodiments of FIGS. 1-3 and the embodiments of FIGS. 6-7 is the addition baffles 310, 320 to direct the combination fluid through shroud 60 and out of fluid flow port 67.

As illustrated in FIGS. 6-7, shroud 60 includes one or more upper baffles 310 and one or more longitudinal baffles 320. Upper baffle(s) 310 include upper portion 311 and two extensions 312 defining baffle cavity 314. Upper portion 311 partially blocks opening 59.

Longitudinal baffles 320 are disposed to the left and right of fluid flow port 67, thereby directing fluid downward through bore 65 toward fluid flow port 67. Upper portions 322 of longitudinal baffles 320 are disposed within cavity 314.

Although not shown in FIGS. 6-7, a screen member such as screen member 70 can be included in the embodiment of FIGS. 6-7. In addition, or alternatively, apertures (not shown) can be disposed through the walls of longitudinal baffles 320 along the length of longitudinal baffles 320 to filter debris from the fluid flowing through the apertures.

In operation, the embodiments of FIGS. 6-7 function in a similar manner as described above with respect to the embodiments of FIGS. 1-3. Like the embodiments of FIGS. 1-3, the combination fluid enters opening 59 of upper end 61 of shroud 60 and flows into cavity 66. The fluid then flows around extensions 312 of upper baffles 310 and flows upward. In so doing, debris within the combination fluid falls out of the flow path and into the bottom of cavity 66 where it is captured. The combination fluid then flows around the upper ends 321 of longitudinal baffles 320 and down toward and ultimately out of fluid flow port 67.

It is to be understood that the invention is not limited to the exact details of construction, operation, exact materials, or embodiments shown and described, as modifications and equivalents will be apparent to one skilled in the art. For example, the mandrel ports can have any shape desired or necessary to increase the velocity of the incoming fluid as it passes through the mandrel ports. Alternatively, a nozzle or other device can be placed within mandrel ports to increase the velocity of the incoming fluid as it flows through the mandrel ports. In addition, the shroud is not required to be disposed concentrically with the mandrel. Instead, it can be disposed eccentrically so that one side has a larger opening compared to another side to facilitate capturing larger sized debris on that side. Nor is the shroud or the mandrel both required to have a circular cross-section. Instead, one or both of the shroud or the screen member can have a square or other cross-sectional shape as desired or necessary to facilitate capturing debris within the cavity of the shroud.

Further, it is to be understood that the term "wellbore" as used herein includes open-hole, cased, or any other type of wellbores. In addition, the use of the term "well" is to be understood to have the same meaning as "wellbore." Moreover, in all of the embodiments discussed herein, upward, toward the surface of the well (not shown), is toward the top of Figures, and downward or downhole (the direction going away from the surface of the well) is toward the bottom of the Figures. However, it is to be understood that the tools may have their positions rotated in either direction any number of degrees. Accordingly, the tools can be used in any number of orientations easily determinable and adaptable to persons of ordinary skill in the art. Accordingly, the invention is therefore to be limited only by the scope of the appended claims.

What is claimed is:

1. A downhole tool for capturing debris within a wellbore, the downhole tool comprising:

a mandrel having a mandrel upper end, a mandrel lower end, a mandrel outer wall surface, and a mandrel inner wall surface defining a mandrel bore;

a shroud disposed around a portion of the mandrel outer wall surface, the shroud partially defining a shroud cavity having a shroud port disposed toward a shroud lower end, the shroud being closed at the shroud lower end and having an opening at a shroud upper end; and a mandrel port disposed through the mandrel inner wall surface and the mandrel outer wall surface and in fluid communication with the mandrel bore, said shroud port surrounding and axially aligned with said mandrel port while extending radially further from said mandrel bore than said mandrel port.

2. The downhole tool of claim 1, wherein the mandrel port is disposed perpendicular to the mandrel bore.

3. The downhole tool of claim 1, further comprising a screen member disposed in the shroud cavity.

4. The downhole tool of claim 1, further comprising a pair of longitudinal baffles disposed along the inner wall surface of the shroud adjacent said shroud port.

5. The downhole tool of claim 4, wherein the shroud opening being partially blocked above the pair of longitudinal baffles.

6. The downhole tool of claim 1, further comprising a second shroud, the second shroud having a second shroud upper end, a second shroud lower end, a second shroud outer wall surface, and a second shroud inner wall surface defining a second shroud bore, the second shroud upper end blocking the opening in the upper end of the shroud, and the second shroud lower end having a second shroud opening in fluid communication with the second shroud bore, the second shroud being disposed at least partially around the outer wall surface of the shroud, a third shroud, the third shroud having a third shroud upper end, a third shroud lower end, a third shroud outer wall surface, and a third shroud inner wall surface defining a third shroud bore, the third shroud lower end being closed and the third shroud upper end having a third shroud opening in fluid communication with the third shroud bore, the third shroud being disposed at least partially around the second shroud outer wall surface, wherein an upper portion of the shroud includes a plurality of apertures disposed through the shroud inner wall surface and the shroud outer wall surface in fluid communication with the shroud bore and in fluid communication with the second shroud bore.

7. The downhole tool of claim 1, further comprising a valve operatively associated with the mandrel port for selectively opening the mandrel port, the valve having a closed position and an opened position, the closed position blocking fluid communication between the mandrel bore and the mandrel port and the opened position allowing fluid communication between the mandrel bore and the mandrel port.

8. The downhole tool of claim 7, wherein the valve comprises a sleeve disposed in at least partial sliding engagement with the mandrel inner wall surface, the sleeve comprising a run-in position, an actuated position, an upper sleeve end, a lower sleeve end, a sleeve outer wall surface, the sleeve outer wall surface being at least partially in sliding engagement with the mandrel inner wall surface, and a sleeve inner wall surface defining a sleeve bore.

9. The downhole tool of claim 1, wherein the mandrel port creates a pressure differential between the shroud port and the opening disposed at the shroud upper end.

10. The downhole tool of claim 9, wherein the mandrel port is disposed perpendicular to the mandrel bore.

11. A downhole tool for capturing debris within a wellbore, the downhole tool comprising:

a mandrel having a mandrel upper end, a mandrel lower end, a mandrel outer wall surface, and a mandrel inner wall surface defining a mandrel bore;

a shroud disposed around a portion of the mandrel outer wall surface, the shroud partially defining a shroud cavity having a shroud port disposed toward a shroud lower end, the shroud being closed at the shroud lower end and having an opening at a shroud upper end; and a mandrel port disposed through the mandrel inner wall surface and the mandrel outer wall surface and in fluid communication with the mandrel bore;

a pair of longitudinal baffles disposed along the inner wall surface of the shroud adjacent said shroud port;

wherein the shroud opening being partially blocked above the pair of longitudinal baffles;

the shroud opening is partially blocked by an upper baffle, the upper baffle having a upper portion and two extensions, the upper portion and two extensions defining a cavity, and wherein an upper portion of each of the pair of longitudinal baffles is disposed within the cavity.

12. A downhole tool for capturing debris within a wellbore, the downhole tool comprising:

a mandrel having a mandrel upper end, a mandrel lower end, a mandrel outer wall surface, and a mandrel inner wall surface defining a mandrel bore;

a shroud disposed around a portion of the mandrel outer wall surface, the shroud defining a shroud cavity having a plurality of shroud ports disposed toward a shroud lower end, the shroud comprising a screen member adjacent the shroud lower end and having an opening at a shroud upper end; and a plurality of mandrel ports disposed through the mandrel inner wall surface and the mandrel outer wall surface and in fluid communication with the mandrel bore, each of the plurality of mandrel ports being disposed below the screen member, said shroud ports surrounding and axially aligned with a respective said mandrel port while extending radially further from said mandrel bore than said respective mandrel port.

13. The downhole tool of claim 12, wherein the shroud further comprises a plurality of shroud ports and a closed lower end.

14. The downhole tool of claim 13, wherein at least one of the plurality of shroud ports is in alignment with at least one of the plurality of mandrel ports.

15. The downhole tool of claim 12, wherein each of the plurality of shroud ports is in alignment with a corresponding one of the plurality of mandrel ports.

16. The downhole tool of claim 15, further comprising a second shroud, the second shroud having a second shroud upper end, a second shroud lower end, a second shroud outer wall surface, and a second shroud inner wall surface defining a second shroud bore, the second shroud upper end blocking the opening in the upper end of the shroud, and the second shroud lower end having a second shroud opening in fluid communication with the second shroud bore, the second shroud being disposed at least partially around the outer wall surface of the shroud, a third shroud, the third shroud having a third shroud upper end, a third shroud lower end, a third shroud outer wall surface, and a third shroud inner wall surface defining a third shroud bore, the third shroud lower end being closed and the third shroud upper end having a third shroud opening in fluid communication with the third shroud bore, the third shroud being disposed at least partially around the second shroud outer wall surface, wherein an upper portion of the shroud includes a plurality of apertures disposed through the shroud inner wall surface and the shroud outer wall surface in fluid communication with the shroud bore and in fluid communication with the second shroud bore.

17. A downhole tool for capturing debris within a wellbore, the downhole tool comprising:

a mandrel having a mandrel upper end, a mandrel lower end, a mandrel outer wall surface, and a mandrel inner wall surface defining a mandrel bore;

a shroud disposed around a portion of the mandrel outer wall surface, the shroud defining a shroud cavity having at least one shroud port disposed toward a shroud lower end, the shroud comprising a screen member adjacent the shroud lower end and having an opening at a shroud upper end; and a plurality of mandrel ports disposed through the mandrel inner wall surface and the mandrel outer wall surface and in fluid communication with the mandrel bore, each of the plurality of mandrel ports being disposed below the screen member;

each of the plurality of shroud ports is in alignment with a corresponding one of the plurality of mandrel ports;

a pair of longitudinal baffles disposed along the inner wall surface of the shroud adjacent the fluid flow port, and an upper baffle having a upper portion and two extensions, the upper portion and two extensions defining a cavity, wherein an upper portion of each of the pair of longitudinal baffles is disposed within the cavity, and wherein the shroud opening is partially blocked by the upper portion of the upper baffle.

18. A method of removing debris from a wellbore fluid, the method comprising the steps of:

(a) flowing an incoming fluid through a mandrel bore of a mandrel and out of a mandrel port disposed through a mandrel inner wall surface and a mandrel outer wall surface, the incoming fluid flowing out of the mandrel port through a cavity partially defined by a shroud disposed around a portion of the mandrel outer wall surface, through a shroud port, and into a wellbore annulus;

(b) positioning said shroud port surrounding and axially aligned with said mandrel port while extending radially further from said mandrel bore than said mandrel port;

(c) after step (a), combining the incoming fluid with a wellbore fluid disposed in the wellbore annulus to form a combination fluid, the wellbore fluid comprising a piece of debris;

(d) flowing the combination fluid upward within the wellbore annulus;

(e) creating a pressure differential at an upper end of the shroud, the pressure differential being created between the cavity and the wellbore annulus, and the pressure differential causing the combination fluid to be drawn into the cavity; and (f) flowing the combination fluid through the shroud cavity causing the piece of debris within the combination fluid to be captured within the cavity formed by the shroud.

19. The method of claim 18, wherein during step (f), the piece of debris is captured by a screen.

20. The method of claim 18, wherein during step (f), the piece of debris is captured by flowing the combination fluid around at least one baffle disposed within the shroud cavity.

21. The method of claim 18, wherein during step (f), the piece of debris is captured by flowing the combination fluid up a second shroud cavity and through a plurality of apertures disposed at an upper end of the shroud.

* * * * *